US007750231B2

(12) United States Patent
Nishida et al.

(10) Patent No.: US 7,750,231 B2
(45) Date of Patent: Jul. 6, 2010

(54) KEYBOARD APPARATUS OF ELECTRONIC MUSICAL INSTRUMENT

(75) Inventors: Kenichi Nishida, Hamamatsu (JP); Yasushi Tamazawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 571 days.

(21) Appl. No.: 11/638,778

(22) Filed: Dec. 13, 2006

(65) Prior Publication Data

US 2007/0131099 A1 Jun. 14, 2007

(30) Foreign Application Priority Data

Dec. 14, 2005 (JP) ..... 2005-359742
Mar. 6, 2006 (JP) ..... 2006-059560

(51) Int. Cl.
*G10H 1/02* (2006.01)
*G10H 5/00* (2006.01)
*G10H 7/00* (2006.01)

(52) U.S. Cl. ..... 84/658; 84/604; 84/626

(58) Field of Classification Search ..... 84/658, 84/626, 604
See application file for complete search history.

(56) References Cited

U.S. PATENT DOCUMENTS 4,506,581 A * 3/1985 Sunada ..... 84/626
4,552,051 A * 11/1985 Takeuchi ..... 84/626
4,633,750 A * 1/1987 Sakai ..... 84/626
4,875,400 A * 10/1989 Okuda et al. ..... 84/626
5,107,748 A * 4/1992 Muramatsu et al. ..... 84/658
5,198,605 A * 3/1993 Konishi ..... 84/658
5,241,124 A * 8/1993 Adachi et al. ..... 84/607
5,338,891 A * 8/1994 Masubuchi et al. ..... 84/600
5,453,571 A * 9/1995 Adachi et al. ..... 84/658
5,552,561 A * 9/1996 Nakada et al. ..... 84/658
5,610,353 A * 3/1997 Hagino ..... 84/604
5,619,005 A * 4/1997 Shibukawa et al. ..... 84/658
5,641,930 A * 6/1997 Nakada et al. ..... 84/658
5,834,668 A * 11/1998 Kumano et al. ..... 84/423 R
6,121,535 A * 9/2000 Muramatsu ..... 84/626
6,255,576 B1 * 7/2001 Suzuki et al. ..... 84/604

(Continued)

FOREIGN PATENT DOCUMENTS

JP 07-295568 A 11/1995

(Continued)

OTHER PUBLICATIONS

Office Action mailed Feb. 9, 2010, for JP Application No. 2006-059560, with Partial English Translation, three pages.

*Primary Examiner*—Jeffrey Donels
*Assistant Examiner*—Christina Russell
(74) *Attorney, Agent, or Firm*—Morrison & Foerster, LLP

(57) ABSTRACT

A keyboard apparatus of this electronic musical instrument is provided with touch curves TW1 through TWp, TB1 through TBq each defining a velocity value Vc varying with a key-depression velocity Kv (TD). Each of keys K1 through Kn of a keyboard 14*k* is associated with one of the touch curves TW1 through Twp, TB1 through TBq by touch selecting tables SW, SB in accordance with an equalization rule and a weighting rule. Upon a key-depression, in accordance with the velocity curve TWr, TBs selected on the basis of an actual depressed key position Ki (M2), an actual key-depression velocity Kva is converted into a velocity Vca for controlling emission of a tone (M3).

7 Claims, 11 Drawing Sheets

U.S. PATENT DOCUMENTS

| | | | | |
|---|---|---|---|---|
| 6,316,710 | B1 * | 11/2001 | Lindemann | 84/609 |
| 6,906,695 | B1 * | 6/2005 | Ishida et al. | 345/156 |
| 2002/0143545 | A1 * | 10/2002 | Tamura et al. | 704/266 |
| 2002/0178006 | A1 * | 11/2002 | Suzuki et al. | 704/258 |
| 2005/0016369 | A1 * | 1/2005 | Sunako | 84/737 |
| 2006/0272482 | A1 * | 12/2006 | Tamura et al. | 84/604 |

FOREIGN PATENT DOCUMENTS

| | | | |
|---|---|---|---|
| JP | 07295568 | A * | 11/1995 |
| JP | 08-076756 | | 3/1996 |
| JP | 08076756 | A * | 3/1996 |
| JP | 09-006329 | | 1/1997 |

* cited by examiner deviation correcting touch curves Tα step easing touch curves Tβ process flow of first equalization/smoothing example

KEYBOARD APPARATUS OF ELECTRONIC MUSICAL INSTRUMENT

BACKGROUND OF THE INVENTION

1. Field of the Invention

The present invention relates to a keyboard apparatus of an electronic musical instrument designed such that the touch response is controlled by way of software.

2. Description of the Related Art

In a conventional keyboard apparatus of an electronic musical instrument, as described in Japanese Patent Laid-Open Publication No. H09-6329, for example, each key is provided with its corresponding mass element referred to as a "hammer" so that a force corresponding to the movement of the mass element brought by a key-depression is yielded as the reaction to the force exerted at the key-depression. As a result, the conventional keyboard apparatus achieves desired touch response having weight which is close to the touch response of the key-depressions of an acoustic musical instrument.

FIG. 1 shows weight characteristics of respective keys of a case in which the touch response of key-depression is mechanically controlled as described above. In order to achieve gradual changes in touch response over all the keys as shown in the characteristics of an acoustic piano indicated by curve "A", the touch response can be mechanically controlled by providing each of the keys composing the keyboard with a hammer (mass element) corresponding to its own touch response or by gradually varying the position of the support of the respective hammers, which requires more space. In either scheme, however, implementation in actual products is difficult due to problems of manufacturability and cost.

Therefore, actual products are designed such that keys of the keyboard are divided into several groups each containing several keys each having a hammer of the same shape and length so that the several keys physically have the same weight. In those products, as a result, the keyboard is provided with several different weights (touch) in the scaling (transverse axis) direction as shown by stepwise heavy line "G". The mechanism in which the keyboard apparatus of the electronic musical instrument is provided with different weights G1 through G4 in the scaling direction is referred to as "graded hammer" (registered trademark of the applicant). The designed weights G1 through G4 in which keys contained in a group mechanically have the same weight are referred to as "grade".

In the keyboard mechanism, however, quite a few movable parts are complicatedly correlated to operate. In addition to tolerances of parts, furthermore, the keyboard mechanism also include many slid areas, resulting in deviation of the weight of the keys contained in a grade. As a result, the weight of the respective keys actually perceived by a player as reaction (touch) deviates from the design as shown by stepwise thin line "Ga". The worst case can exhibit an inversion phenomenon between light hammers and heavy hammers in which, for example, a key included in the low grade (upper register: high notes) G3 designed to have a light hammer in order to provide the player with a light touch actually provides the player with a heavier touch than keys having a heavier hammer included in the higher grade (lower register: low notes) G2.

Because the graded hammer mechanism has a limit to the number of mechanically available hammer types, furthermore, connections between the grades each having a hammer of different weight result in steps. As a result, there is no way but to draw a stepwise line in the scaling direction brought by the weights of the respective keys as shown by the curve "G". On the acoustic piano, more specifically, the touch of respective keys gradually varies from key to key as shown by curve "A", which contributes the player to perceive changes of the touch of the keys as smooth. On the electronic musical instrument of the graded hammer type having several different kinds of hammers, on the other hand, boundaries D1 through D3 where grade-transfer takes place between the hammer grades G1 through G4 produce significant steps between the weights as shown by the curve "G". Some players realize the steps, which results in their decreased quality satisfaction.

SUMMARY OF THE INVENTION

The present invention was accomplished to solve the above-described problems, and an object thereof is to provide a keyboard apparatus of an electronic musical instrument whose mechanically provided touch response can be further controlled by software to perceptively equalize mechanically provided deviation of touch response of the keyboard or perceptively smooth out mechanically provided stepwise touch response.

In order to achieve the above-described object, it is a feature of the present invention to provide a keyboard apparatus of an electronic musical instrument comprising a keyboard (14*k*) containing a plurality (n: 88, for example) of keys (K1 through Kn) having a reaction force mechanism for exerting a reaction force at each key-depression, a key-depression detecting portion (M1, S2, 5, P1, Q1) for detecting a depressed key position (ki) and a key-depression velocity (Kva) on the basis of a key-depression on the keyboard (14*k*), and a velocity generating portion (M2, M3, S3, S4) for generating a velocity (Vca) in accordance with a specified velocity generation rule (rv) on the basis of the depressed key position (Ki) and the key-depression velocity (Kva) detected by the key-depression detecting portion, the velocity generation rule (rv) including a velocity response rule (rv0) for providing a small velocity (Vc) for a key-depression having a small key-depression velocity (Kv), and providing a large velocity (Vc) for a key-depression having a large key-depression velocity (Kv) if positions of the depressed keys (Ki) are identical, and a touch response correction rule for providing a large velocity for a key exerting an excessive reaction force at a key-depression, and providing a small velocity for a key exerting an insufficient reaction force at a key-depression if the keys are depressed with an identical velocity.

In this case, the touch response correction rule is, for example, an equalization rule (rv1) for providing a large velocity (Vc) for a depression of a key (Ki) exerting a largely deviating reaction force (TW2, Vca'), and providing a small velocity (Vc) for a depression of a key exerting a slightly deviating reaction force (TW3, Vca) if the keys are depressed with an identical velocity (Kv). According to the feature, mechanically provided deviations of the reaction force (weight) of the respective keys of the keyboard are perceptively absorbed to smooth out the touch response of the keys by the touch-response control by software including the velocity response rule (rv0) and the equalization rule (Rv1).

Furthermore, the touch response correction rule is, for example, a weighting rule (rv2) for providing a small velocity (Vc) for a depression of a key (Ki) positioned at a low note side (in a low register) (K16) (TW14), and providing a large velocity (Vc) for a depression of a key positioned at a high note side (in a high register) (K39) (TW1) if the keys are depressed with an identical velocity (Kv). In a case where all the keys of the keyboard have a uniform reaction force, or in a case where the keyboard is provided with a mechanical reaction force mechanism having stepwise reaction forces (weights) with each key range having a uniform reaction force (weight), more specifically, the keys having a uniform reaction force are weighted by the software including the velocity response rule (rv0) and the weighting rule (rv2) so that keys positioned at the low note side (in the lower registers) yield a smaller velocity if the keys are depressed with the same velocity. As a result, the keys corresponding to the low notes (the lower registers) are perceived as heavier, while the keys corresponding to the high notes (the upper registers) are perceived as lighter, achieving perceptive control of the touch response in the scaling direction (in the direction toward which pitches advance). Thus, the gradual changes in the touch response of the keyboard in the scaling direction are achieved by the touch-response control by the software.

In addition, the touch response correction rule is, for example, a key-range weighting rule (rv2) for providing a small velocity (vc) for a depression of a key (Ki) positioned at a low note side (in a low register) in one of a plurality of key ranges into which the plurality of keys are divided, and providing a large velocity (Vc) for a depression of a key positioned at a high note side (in a high register) in the key range if the keys are depressed with an identical velocity (Kv). On the keyboard of the graded hammer type having mechanical stepwise touch response, more specifically, the software including the velocity response rule (rv0) and the key-range weighting rule (rv2) causes keys in the low notes (the lower registers) in a key range having the same grade to yield a smaller velocity if the keys are depressed with the same velocity, achieving perceptive control of the touch response in the scaling direction (in the direction toward which pitches advance) so that the keys corresponding to the low notes (the lower registers) in a grade (key range) are perceived as heavier with the keys corresponding to the high notes (the upper registers) in the grade being perceived as lighter. As a result, steps between neighboring grades are eliminated. According to the present invention, therefore, the perceptive touch-response control by the software brings about gradual changes in the scaling direction in the touch response of the respective key ranges of the keyboard of graded hammer type mechanically having stepwise touch response, providing the player with the touch response gradually varying over all the keys of the keyboard without mechanical control of the keys.

Furthermore, the velocity generation rule (rv) is, for example, separated into a white-key rule (rvw, TW, SW) and a black-key rule (rvb, TB, SB), and the velocity generating portion (M3, S4) applies the white-key rule (rvw) to a case in which a depressed key position (Ki) detected by the key-depression detecting portion (M1, S2) is a white key (W), and applies the black-key rule (rvb) to a case in which the depressed key position (Ki) is a black key (B). In other words, the touch-control process is separately performed for the white keys and the black keys. According to the invention, therefore, the white keys and the black keys each having their own operational workings and reaction force workings can realize the optimal touch response.

According to another aspect of the invention, it is a feature of the invention to include a keyboard (14*k*) containing a plurality of keys having a reaction force mechanism for exerting a reaction force at each key-depression, a key-depression detecting portion (M1, S2, 5, P1, Q1) for detecting a depressed key position (Ki) and a key-depression velocity (Kva) on the basis of a key-depression on the keyboard (14*k*), a variation characteristic data storage portion (3, 4, TD) for storing, in association with depressed key position, a plurality of variation characteristic data representative of characteristics of velocity varying with key-depression velocity, the plurality of variation characteristic data being provided for correcting key-touch response, a variation characteristic selecting portion (M2, S3, P2, P4, Q2) for selecting, from among the plurality of variation characteristic data stored in the variation characteristic data storage portion, a variation characteristic data in accordance with a depressed key position detected by the key-depression detecting portion, and a velocity converting portion (M3, S4, P3, P5, Q3) for converting a key-depression velocity detected by the key-depression detecting portion into a velocity by use of the variation characteristic data selected by the variation characteristic selecting portion. In this case, for example, the plurality of variation characteristic data provided in association with depressed key position are provided for correcting key touch response relating to at least one of deviating reaction forces exerted by the plurality of keys and a reaction force exerted by a key contained in a key range of a plurality of key ranges into which the plurality of keys are divided. Furthermore, each of the plurality of variation characteristic data represents a curve of velocity varying with key-depression velocity.

According to still another aspect of the invention, it is a feature of the invention to replace the variation characteristic data storage portion, the variation characteristic selecting portion and the velocity converting portion with a parameter storage portion (3, 4) for storing, in association with depressed key position, a plurality of parameters for calculating a velocity on the basis of a key-depression velocity, the plurality of parameters being provided for correcting key-touch response, a parameter selecting portion (M2A, R1) for selecting, from among the plurality of parameters stored in the parameter storage portion, a parameter in accordance with a depressed key position detected by the key-depression detecting portion, and a velocity calculating portion (M3A, R2) for calculating a velocity on the basis of a key-depression velocity detected by the key-depression detecting portion by use of the parameter selected by the parameter selecting portion. In this case, the plurality of parameters provided in association with depressed key position are provided for correcting key touch response relating to at least one of deviating reaction forces exerted by the plurality of keys and a reaction force exerted by a key contained in a key range of a plurality of key ranges into which the plurality of keys are divided.

According to these features as well, mechanically provided deviations of the reaction force (weight) of the respective keys of the keyboard are perceptively absorbed to smooth out the touch response of the keys by the touch-response control by software. In addition, the perceptive touch-response control by the software brings about gradual changes in the scaling direction in the touch response of the respective key ranges of the keyboard of graded hammer type mechanically having stepwise touch response, providing the player with the touch response gradually varying over all the keys of the keyboard without mechanical control of the keys.

DESCRIPTION OF THE PREFERRED EMBODIMENT

[System Overview]

Figure 2:
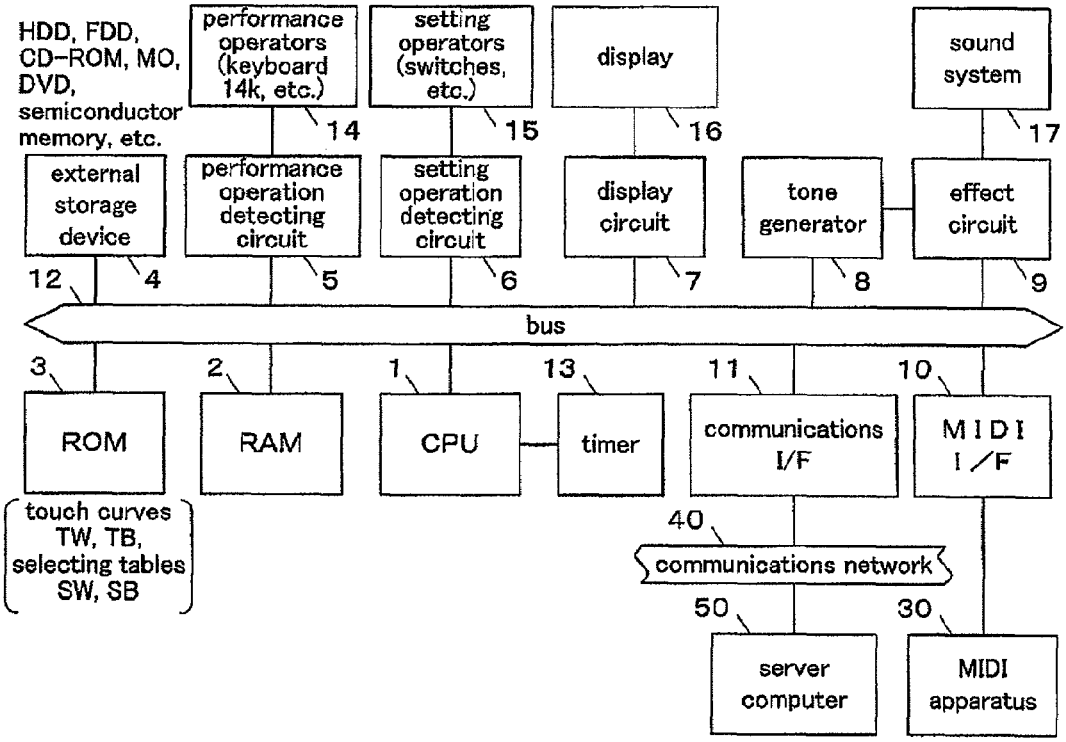
Prior Art FIG.2
FIG. 2 is a block diagram showing a hardware configuration of an electronic musical instrument according to an embodiment of the present invention.

FIG. 2 is a block diagram showing a hardware configuration of an electronic musical instrument according to an embodiment of the present invention. The electronic musical instrument has a central processing unit (CPU) 1, a random-access memory (RAM) 2, a read-only memory (ROM) 3, an external storage device 4, a performance operation detecting circuit 5, a setting operation detecting circuit 6, a display circuit 7, a tone generator 8, an effect circuit 9, a MIDI interface (I/F) 10, a communications interface (I/F) 11 and the like. These elements 1 through 11 are interconnected through a bus 12.

On the basis of specified control programs, the CPU 1 executes various music information processes including a touch-control process (also referred to as a touch response providing process or a touch response correcting process) through the use of a clock operated by a timer 13. The RAM 2 is used as a working area for temporarily storing various kinds of data necessary for the music information processes. In order to achieve the music information processing, the ROM 3 previously stores various control programs including a touch-control process program, various kinds of control data such as touch curve data (also referred to as velocity curve data [also simply referred to as velocity curve], however, hereinafter simply referred to as "touch curve") TW, TB, and touch curve selecting tables SW, SB, preset automatic performance data and the like.

In addition to integrated storage media such as a hard disk (HD) and a rewritable nonvolatile semiconductor memory, the external storage device 4 includes various portable external storage media such as a compact disk-read-only memory (CD-ROM), flexible disk (FD), magneto-optical disk (MO), digital versatile disk (DVD), compact memory card such as Smart Media (trademark). Any given data may be stored in any desired storage medium of the external storage device 4. Control data such as the touch curves TW, TB and the touch curve selecting tables SW, SB can be stored in the integrated storage media (HD and the like) as needed. Particularly, control data such as the touch curve selecting tables SW, SB is stored in a storage medium by a manufacturer prior to shipment of the electronic musical instrument.

Performance operators 14 connected to the performance operation detecting circuit 5 are provided with a keyboard 14*k* as a main performance operators. The performance operators 14 also include supplemental operators such as pedals and wheels. The performance operation detecting circuit 5 detects player's operation of the performance operators 14 and delivers performance information corresponding to the detected operation to a main unit of the system. The setting operation detecting circuit 6 detects player's operation of setting (panel) operators 15 such as switches and a mouse, and delivers setting information corresponding to the detected operation to the main unit of the system. The display circuit 7 is provided with a display 16 such as an LCD on which various screens including a screen for selecting performance data are displayed. The display circuit 7 also includes various indicators (not shown). The display circuit 7 controls the display of the display 16 and illumination of the indicators under the direction of the CPU 1 to achieve both the display guidance for player's operation of the operators 14, 15 and the display of performance in accordance with the operation of the operators 14, 15.

The tone generator 8 and the effect circuit 9, both of which can include software, serve as a musical tone signal generating portion (also referred to as a tone generating portion) which performs processing for emitting tones in accordance with a keyboard performance. More specifically, the tone generator 8 generates a musical tone signal corresponding to musical tone data indicative of a position of a depressed key and a velocity, the position and the velocity being defined on the basis of a performance operation of the keyboard 14*k*. The effect circuit 9 includes an effect adding DSP and adds various effects to musical tone signals supplied from the tone generator 8. A sound system 17 which is situated behind the effect circuit 9 has a digital-to-analog converter, amplifiers and speakers, and emits musical tones based on the musical tone signals supplied form the effect circuit 9. The musical tone signal generating portion 8, 9 can also generate musical tone signals on the basis of automatic performance data supplied from the storage portions 3, 4.

The MIDI I/F 10 is also connected to an additional MIDI musical apparatus 30 to allow the keyboard apparatus of the electronic musical instrument to transmit and receive MIDI performance data to/from the additional musical apparatus 30. The communications I/F 11 is also connected to a communications network 40 such as the Internet and a local area network (LAN) to allow the electronic musical instrument to receive control programs and various kinds of data from an external server computer 50 or the like to store the received programs and data in the external storage device 4.

[Overview of Weight Characteristics and Touch Control of Keyboard]

Figure 3A:
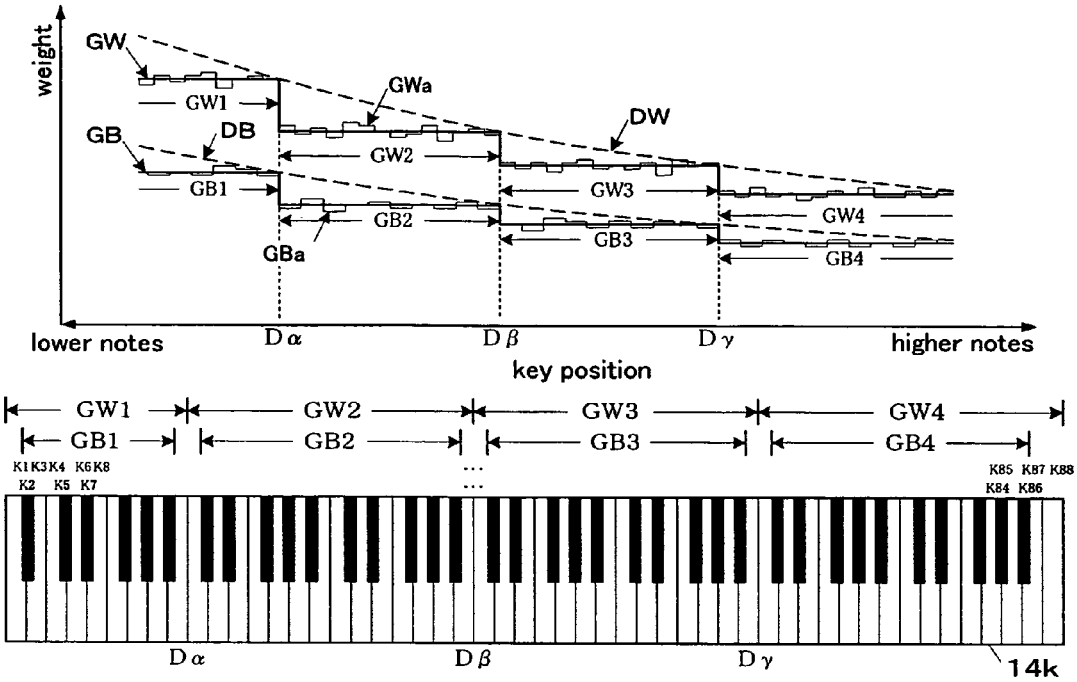
FIG. 3A is a diagram for explaining weight characteristics of a keyboard of the electronic musical instrument according to the embodiment of the present invention.
Figure 3B:
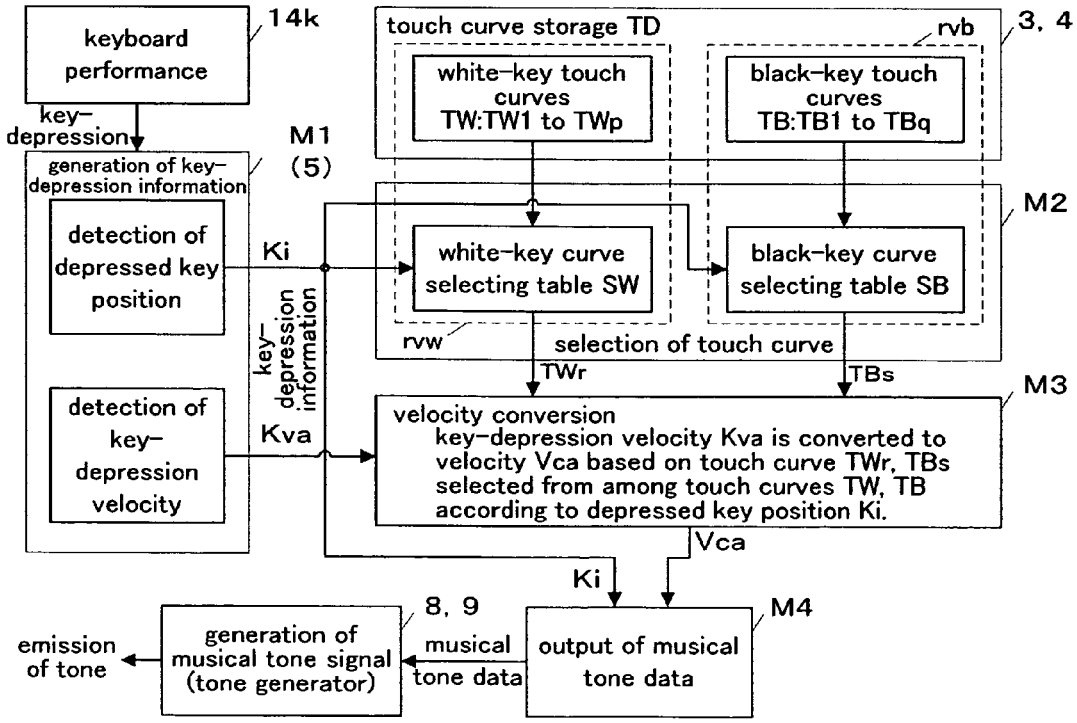
FIG. 3B is a block diagram showing touch response control functions of the keyboard of the electronic musical instrument according to the embodiment of the present invention.

In the electronic musical instrument according to the embodiment of the present invention, player's operation of depressing a key of the keyboard to play music causes generation of a velocity corresponding to the depression of the key in accordance with a velocity generation rule including an equalization rule and a weighting rule in order to correct key-touch response. On the basis of the equalization rule of the velocity generation rule, a velocity determined in accordance with a reaction force provided for a depressed key is generated to perceptively absorb deviation of the reaction force of the key to offer equalized touch response to the player. On the basis of the weighting rule of the velocity generation rule, velocity is generated such that the keys at the low note side have a smaller velocity so that the touch response in the scaling direction (in the direction toward which pitches advance) are weighted more. These rules eliminate the need for elaborate workings and adjustment of the keyboard, and overcome drawbacks of the mechanical workings of the keyboard by way of software, perceptively equalizing deviations of the touch response in one grade and perceptively smoothing connections between grades. FIGS. 3A, 3B depict mechanical weight characteristics of the keyboard of the electronic musical instrument according to the embodiment of the present invention, and provide an overview of touch-control functions of the keyboard having the weight characteristics.

Hereinafter, a brief explanation of characteristics of the keyboard apparatus of the electronic musical instrument according to the embodiment of the invention will be given with reference to FIGS. 3A, 3B. The keyboard apparatus of this electronic musical instrument is provided with p number of touch curves TW1 through TWp and q number of touch curves TB1 through TBq each indicative of velocity characteristics (Kv-Vc characteristics) defining a velocity value Vc corresponding to its key-depression velocity Kv (TD). Each of keys K1 through Kn of the keyboard 14*k* is associated with one of the touch curves TW1 through TWp, TB1 through TBq on the basis of the touch selecting tables SW, SB in accordance with the velocity generation rule (rv) including the equalization rule (rv1) and the weighting rule (rv2). When a key of the keyboard 14*k* is depressed, an actual position Ki of the depressed key and an actual key-depression velocity Kva are detected (M1) to refer to a velocity curve TWr, TBs selected on the basis of the actual key-depression position Ki (M2), so that the actual key-depression velocity Kva is converted to a velocity Vca for controlling generation of a tone (M3). Therefore, the keyboard apparatus of the electronic musical instrument controls perceptive key-touch response by way of software to perceptively correct deviations (GWa, GBa) and steps (Dα through Dγ) of stepwise touches GW, GB mechanically provided for the keys. As a result, the keyboard apparatus of the electronic musical instrument enables the player to obtain equalized/weighted desired touch response (e.g., gradually decreasing desired weight characteristics DW, DB).

Figure 1:
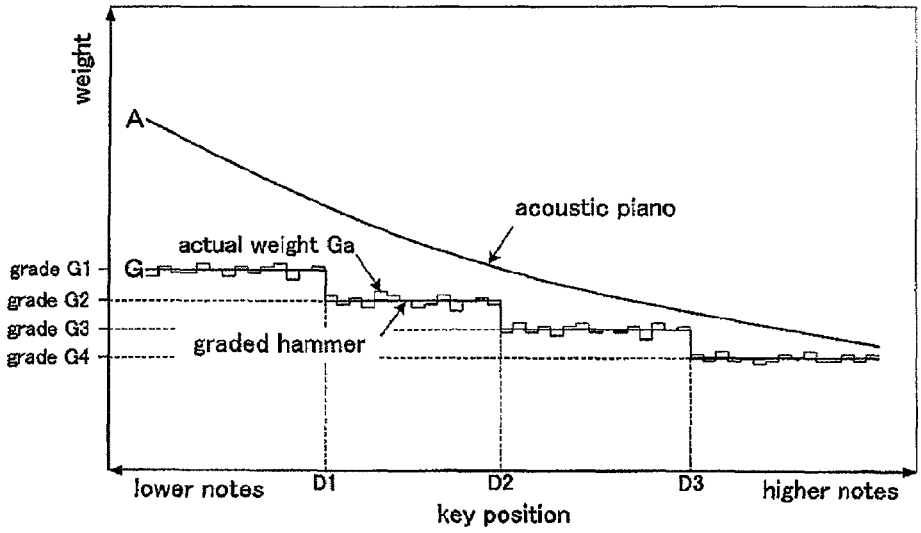
FIG. 1 is a diagram for explaining weight characteristics of respective keys of a conventional keyboard apparatus.

A detailed explanation will now be given. In the keyboard apparatus of this electronic musical instrument, as shown in FIG. 3A, each of a plurality (n) of keys K1 through Kn ("n" is 88 in the shown example) composing the keyboard 14*k* is provided with a reaction force mechanism for exerting a weight (reaction force) at each depression of the key. A plurality of white keys K1, K3, K4, K6 . . . K85, K87, K88 are divided into a plurality of key ranges GW1 through GW4 in accordance with their respective reaction force mechanisms. A plurality of black keys K2, K5, K7 . . . K84, K86 are divided into a plurality of key ranges GB1 through GB4 in accordance with their respective reaction force mechanisms. In other words, these reaction force mechanisms are designed such that the weight characteristics of the keys exhibit a stepwise shape between the ranges due to differences in mass elements (hammer) or the like as in the case of the conventional art depicted in FIG. 1. More specifically, each key contained in one key range is provided with a weight of the same level, with the key ranges in the lower tones of the key ranges GW1 through GW4, GB1 through GB4 being provided with a greater weight. A weight level which is provided for respective keys of one key range is referred to as a grade, while the key range for which one weight level is provided is also referred to as a grade (or a grade range) (hereinafter both are provided with the same reference code). In actual products, however, due to tolerances of parts of the keyboard mechanism, each key of the white keys K1 through K88 and the black keys K2 through K86 fallen into one grade can have different weight characteristics GWa, GBa, respectively, as shown by thin lines in FIG. 3A.

In the shown example, the key ranges of the grades GW1 through GW4 provided for the white keys K1 through K88 agree with those of the grades GB1 through GB4 of the black keys K2 through K86, respectively, however, the key ranges can disagree. In the shown example, furthermore, both the white keys and the black keys are divided into four grades, respectively, however, the number of the grades can be any number. In addition, the number of the grades can be different between the white keys and the black keys. In the reference codes, "W", "w" and "B", "b" indicate the white keys and the black keys, respectively.

On the keyboard apparatus of this electronic musical instrument, the operational mechanism is different between the white keys and the black keys. In addition, the reaction force mechanism is also different between the white keys and the black keys. In addition to the grades separately provided for the white keys and the black keys, therefore, the processing for touch-control is separately performed for the white keys and the black keys. As shown in FIG. 3B, more specifically, the velocity generation rule rv for generating a velocity in accordance with the key-depression of a white key and black key is separated into a white-key rule rvw and a black-key rule rvb to realize optimal touch response for the white keys and the black keys, respectively. For that purpose, as shown in FIG. 3B, the ROM 3 or the external storage device (integrated storage medium such as HDD) 4 is provided with a touch curve storage area TD and a curve selecting table storage area to store control data for the white keys and the black keys in the respective storage areas.

The velocity generation rule rv includes a velocity response rule rv0, an equalization rule rv1 and a weighting rule rv2. On the basis of the velocity response rule rv0, a depression of a key yields a small velocity when the velocity of the key-depression is small, while a depression of the same key yields a large velocity when the velocity of the key-depression is large. On the basis of the equalization rule rv1, a key-depression yields a large velocity when the reaction force of the depressed key greatly deviates, while a key-depression yields a small velocity when the reaction force of the depressed key deviates less if the keys are depressed with the same key-depression velocity. In other words, the equalization rule rv1 equalizes or alleviates deviations of the reaction force of the keys. On the basis of the weighting rule rv2, a key-depression yields a small velocity when the depressed key is positioned at a low note side, while a key-depression yields a large velocity when the depressed key is positioned at a high note side if the keys are depressed with the same key-depression velocity. Due to the weighting rule rv2, in other words, a plurality of keys having a flat reaction force are weighted.

The touch curve storage area TD stores a plurality (p) of white-key touch curve TW:TW1 through TWp (code TW indicates a set of TW1 through TWp) and a plurality (q) of touch curve TB:TB1 through TBq (code TB indicates a set of TB1 through TBq). The respective touch curves TW1 through TWp, TB1 through TBq represent velocity characteristics (Kv-Kc characteristics) defining a velocity (Vc) whose value varies in accordance with a value of a key-depression velocity (Kv). The slope of the respective curves is defined in accordance with the velocity response rule rv0.

The curve selecting table storage area stores white-key and black-key curve selecting tables SW, SB. On the basis of the white-key and black-key curve selecting tables SW, SB, each of the white keys K1 through K88 and the black keys K2 through K86 of the keyboard 14*k* is previously associated with one of the touch curves TW1 through TWp, TB1 through TBq. The association (position of the respective curves in the pitch direction) is determined in accordance with the equalization rule rv1 and the weighting rule rv2.

In an example of (a) where respective keys contained in each grade have a different actual weight characteristics GWa, GBa, in order to make the touch response of the respective keys of each grade agree with a designed weight characteristics GW of each grade, the association is made in accordance with the equalization rule rv1 such that each key is associated with a touch curve having velocity characteristics (Kv-Vc characteristics) corresponding to the difference between the actual weight characteristics GWa, GBa of the key and the designed weight characteristics GW of its grade.

In another case of (b) where actual weight characteristics GWa, GBa of the keys contained in the respective grades GW1 through GW4, GB1 through GB4 agree with (or can be assumed to agree with) their designed weight characteristics GW, GB, in order to make the touch response of the white keys and the black keys agree with the ideal weight characteristics DW, DB shown in FIG. 3A, the association is made in accordance with the weighting rule rv2 such that each key of the white keys and the black keys is associated with a touch curve having velocity characteristics (Kv-Vc characteristics) corresponding to the difference between the weight characteristics GW, GB of the key and the ideal weight characteristics DW, DB. In other words, each of the keys of each grade is associated with a touch curve having velocity characteristics such that, if depressions of the keys of the grade have the same velocity, the key-depressions at the low note side yield a smaller velocity.

In the other case of (c) where respective keys of each grade have different actual weight characteristics GWa, GBa, in order to make the touch response of the white keys and the black keys agree with the ideal weight characteristics DW, DB shown in FIG. 3A, the association is made in accordance with the equalization rule rv1 and the weighting rule rv2 such that each key of each grade is associated with a touch curve having velocity characteristics (Kv-Vc characteristics) corresponding to the difference between the actual weight characteristics GWa, GBa of the key and the ideal weight characteristics DW, DB. In other words, each grade has a tendency that if depressions of the keys of the grade have the same velocity, the key-depressions at the low note side yield a smaller velocity, but precisely, each key is associated with a touch curve having velocity characteristics which complement the difference between the actual weight characteristics GWa, GBa of the key and the designed weight characteristics GW.

As shown in FIG. 3B, the keyboard apparatus of this electronic musical instrument further includes a key-depression information generating portion M1, a touch curve selecting portion M2, a velocity converting portion M3 and a musical tone data outputting portion M4. The key-depression information generating portion M1, which is a portion that performs functions given to the performance operation detecting circuit 5, detects a position of a depressed key (key number or note number) Ki and a velocity of the key-depression (velocity of a keystroke) Kva on the basis of a player's key-depression during player's performance of the keyboard apparatus 14*k*, and generates key-depression information composed of the depressed key position Ki and the key-depression velocity Kva. The key-depression information generating portion M1 then outputs information indicating the depressed key position Ki to the touch curve selecting portion M2 and the musical tone data outputting portion M4, and also outputs information indicating the key-depression velocity Kva to the velocity converting portion M3.

In a case where the depressed key position Ki delivered from the key-depression information generating portion M1 indicates a white key, the touch curve selecting portion M2 refers to the white-key curve selecting table SW to select a white-key touch curve TWr (r=1 through p) associated with the key represented by the depressed key position Ki. In a case where the depressed key position Ki indicates a black key, the touch curve selecting portion M2 refers to the black-key curve selecting table SB to select a black-key touch curve TBs (s=1 through q) associated with the key represented by the depressed key position Ki.

The velocity converting portion M3 obtains a value Vca of a velocity Vc corresponding to the key-depression velocity Kva on the basis of the velocity characteristics (Kv-Vc characteristics) indicated by the touch curve TWr, TBs selected by the touch curve selecting portion M2. In other words, the velocity converting portion M3 converts the key-depression velocity Kva to the velocity Vca which is used to control tone emission. The velocity converting portion M3 then outputs the converted velocity Vca to the musical tone data outputting portion M4.

The musical tone data outputting portion M4 then outputs musical tone data in which the depressed key position Ki delivered from the key-depression information generating portion M1 and the velocity Vca delivered from the velocity converting portion M3 are paired to the musical tone signal generating portion 8, 9. The musical tone signal generating portion 8, 9 manipulates the musical tone data for emitting a tone to generate a musical tone signal. The musical tone signal generating portion 8, 9 then causes the sound system 17 to emit a musical tone corresponding to the generated musical tone signal.

As described above, the keyboard apparatus of this electronic musical instrument is designed to obtain a velocity Vca for controlling emission of a tone on the basis of an actual key-depression velocity Kva in conjunction with a touch curve previously associated with each key. Therefore, drawbacks of the mechanical reaction force workings can be overcome through the touch response control by software as follows. In a case where the keyboard apparatus has mechanical deviations in the touch response as described in the case of (a), the equalization rule rv1 is adopted to absorb the deviations by the touch response control, providing the player with perceptively uniform touch response. In a case where the keyboard apparatus is designed to mechanically have the stepwise touch response as described in (b), the weighting rule rv2 is adopted to smooth out the touch response over all the grades so that the player perceives gradual changes in the touch response in the scaling direction (in the direction toward which pitches advance) as indicated by the ideal weight characteristics DW, DB. In a case where the keyboard apparatus is designed to mechanically have the stepwise touch response as well as deviations of the touch response in each grade as described in the case of (c), the equalization rule rv1 and the weighting rule rv2 are adopted for respective grades to absorb the deviations of the touch response in each grade to provide the player with perceptively uniform touch response, as well as to smooth out the touch response over all the grades so that the player perceives gradual changes in the touch response in the scaling direction as indicated by the ideal weight characteristics DW, DB.

[Principles of Equalization and Smoothing of Touch Response]

FIGS. 4A through 4C and FIGS. 5A through 5C are diagrams which explain principles of capabilities of equalizing and smoothing touch response, the capabilities being provided for the electronic musical instrument according to the embodiment of the invention. In these figures, explanations are made for the white keys, however, these capabilities can be also applied to the black keys in the similar manner.

[1] Case of (a)

Figure 4A:
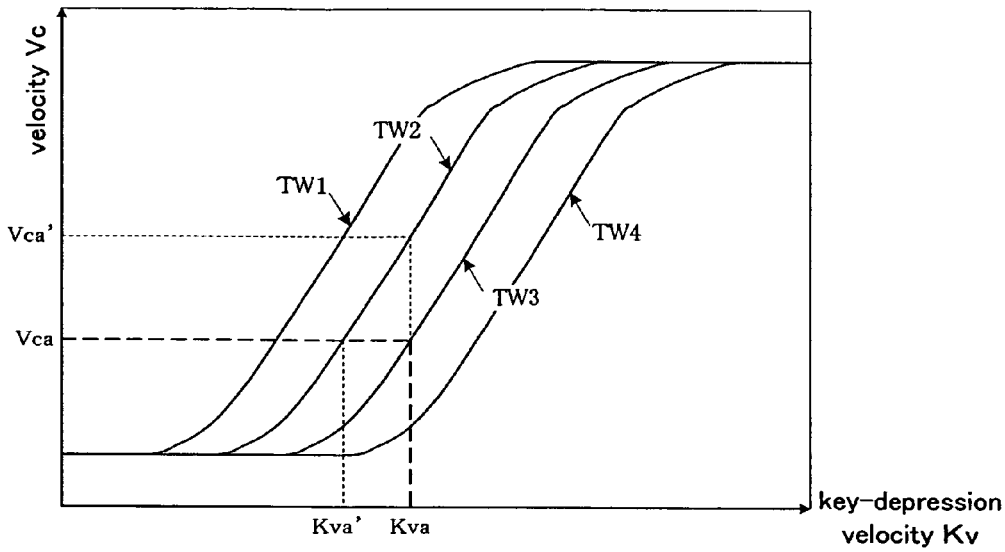
FIG. 4A is a diagram showing characteristics of touch curves (velocity curves) with respect to key-depression velocity for equalizing touch response of the keyboard.
Figure 4B:
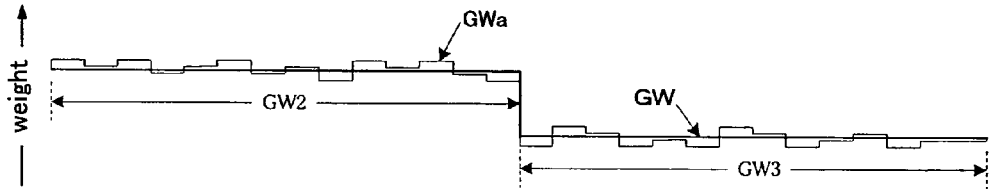
FIG. 4B is a diagram for explaining differences between designed weight characteristics and actual weight characteristics of the keyboard.
Figure 4C:
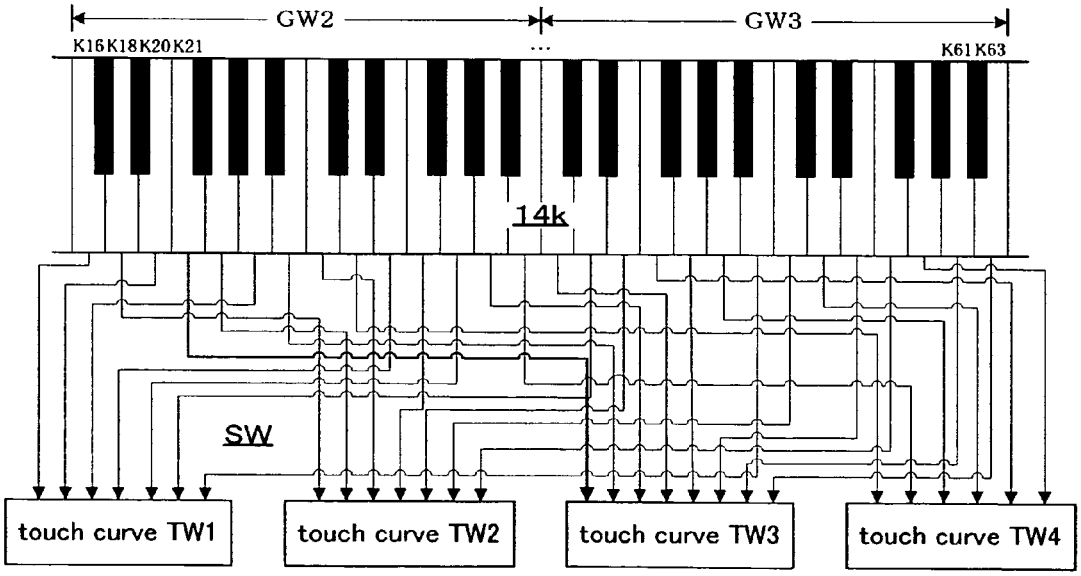
FIG. 4C is a diagram for explaining selection of touch curve (velocity curve) for equalizing touch response on keys of the keyboard.

FIGS. 4A through 4C show a simplified example of the above-described case of (a) in which control of perceptive touch response has been exercised by use of the touch curves to provide the player with desired touch response. The actual weight characteristics GWa exerted on the respective keys of the keyboard 14*k* by the reaction force mechanism can vary even among the keys contained in one grade due to tolerances or the like. As shown in FIG. 4B, in this example, respective keys of the grades GW2, GW3 have a deviation classified under four tiers (1: heavy 2: relatively heavy 3: relatively light 4: light) from the designed weight characteristics GW.

As shown in FIG. 4A, the touch curve storage area TD stores four different touch curves (velocity curves) TW1 through TW4 (1: making the key perceived as light 2: making the key perceived as relatively light 3: making the key perceived as relatively heavy 4: making the key perceived as heavy). The respective touch curves represent velocity characteristics (Kv-Vc characteristics) defining a velocity Vc which varies according to the value of a key-depression velocity Kv. Therefore, the value of the key-depression velocity yielding a certain velocity value Vca varies among the touch curves depending on the extent of the weight. In order to obtain a certain velocity value Vca, more specifically, the touch curve TW3 which makes the key perceived as relatively heavy requires a relatively great key-depression velocity Kva, while the touch curve TW2 which makes the key perceived as relatively light requires a relatively small key-depression velocity Kva'.

The touch curve selecting table SW associates the respective keys with the touch curves TW1 through TW4 in accordance with the difference between the actual weight characteristics GWa of the respective keys and the designed weight characteristics GW. As shown in FIG. 4C, more specifically, the keys having a light touch are assigned a touch curve which makes the keys perceived as heavy, while the keys having a heavy touch are assigned a touch curve which makes the keys perceived as light. In other words, the key association with the touch curves TW1 through TW4 is made such that the touch curves are assigned to the respective keys to cancel static and dynamic weight deviations and differences of switching time caused by deviations of the contact where a key-depression is detected.

For example, if the player depresses a mechanically "slightly light" key K21, the touch curve selecting portion M2 selects the touch curve TW3 which makes the key perceived as relatively heavy in accordance with the correspondence defined by the touch curve selecting table SW. As shown in FIG. 4A, the velocity converting portion M3 then outputs the velocity value Vca provided for the touch curve TW3, the velocity value Vca corresponding to the key-depression velocity Kva.

If a "slightly heavy" key K23 (code is not shown) is depressed, the touch curve TW2 which makes the key perceived as slightly light is selected. In this case, if the player depresses the "slightly heavy" key K23 with the same key-depression velocity Kva as the key-depression of the key K21, the velocity converting portion M3 outputs a greater velocity Vca'. In order to output a velocity Vca which is the same velocity as the key-depression of the key K21, however, the player is required to depress the key K23 with a smaller force than the key-depression of the key K21 so that a smaller key-depression velocity Kva'is input to the velocity converting portion M3.

In the case of (a), in other words, the keyboard apparatus is controlled such that the keys whose touch is mechanically light require a faster key-depression velocity brought by a keystroke with a great reaction force in order to obtain a loudness of the same level as the other keys, while the keys whose touch is mechanically heavy are allowed to obtain a loudness of the same level as the other keys in spite of a slower key-depression velocity by a keystroke with a small reaction force. Regardless of physical weight differences in the touch, as a result, the keyboard apparatus can be controlled such that the keys provide the player with the same touch response to yield the same loudness. More specifically, the touch response is perceptively controlled such that mechanical deviations of the touch are absorbed to equalize the touch response by assigning a heavy touch curve (making the key perceived as heavy) to mechanically light keys, and assigning a light touch curve (making the key perceived as light) to mechanically heavy keys.

This example is described with a case having the four different touch curves TW1 through TW4, however, the number of the touch curves is not limited to four. Touch curves of the same number as the total number of the keys may be provided to allow subtle control. In this case, the touch selecting table SW defines correspondence between a key and a touch curve in a one-to-one relationship.

[2] Case of (b)

Figure 5A:
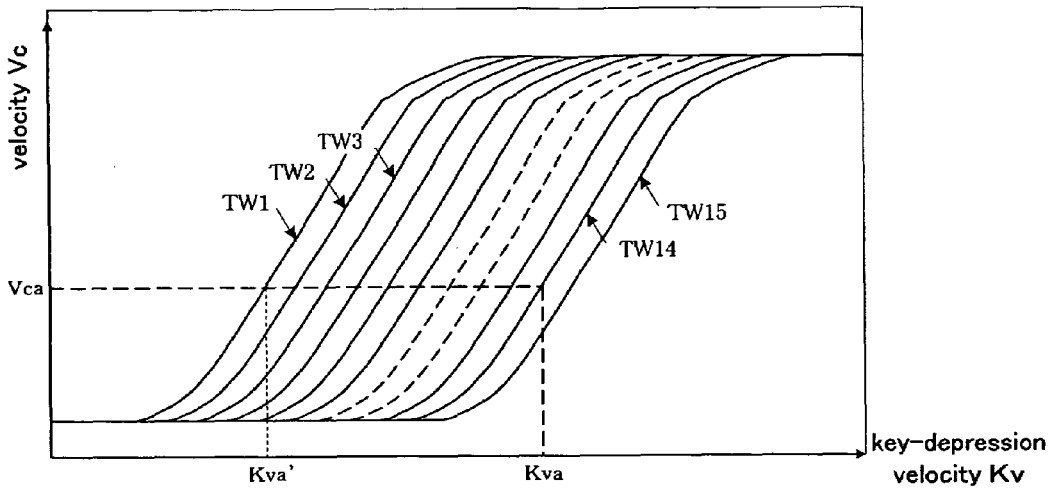
FIG. 5A is a diagram showing characteristics of touch curves (velocity curves) with respect to key-depression velocity for smoothing touch response of the keyboard.
Figure 5B:
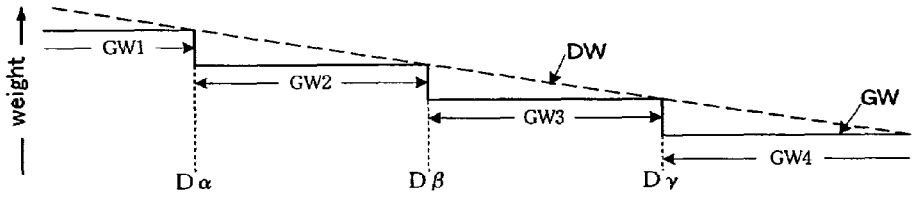
FIG. 5B is a diagram for explaining differences between graded weight characteristics and gradually decreasing desired weight characteristics of the keyboard.
Figure 5C:
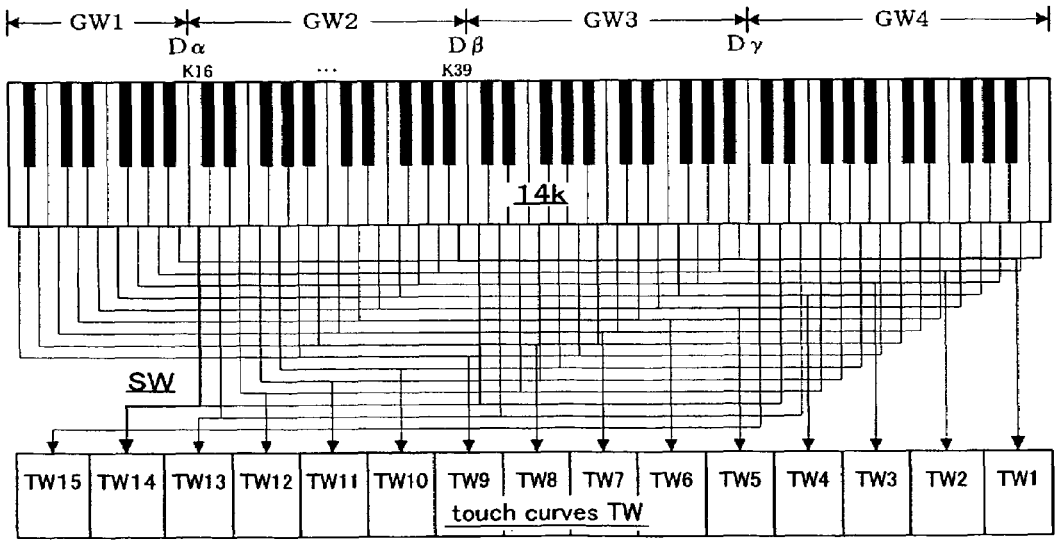
FIG. 5C is a diagram for explaining selection of touch curve (velocity curve) for smoothing touch response on keys of the keyboard.

FIGS. 5A through 5C show a simplified example of the above-described case of (b) in which control of perceptive touch response has been exercised by use of the touch curves to provide the player with desired touch response DW which gradually changes in the scaling direction (in the direction toward which pitches advance). The case of (b) is assumed that, as shown in FIG. 5B, due to the reaction force mechanism, the respective keys of the keyboard 14*k* have the weight characteristics GW having grades GW1 through GW4 as designed.

As shown in FIG. 5A, the touch curve storage area TD stores fifteen different touch curves (velocity curves) TW1 through TW15. The value of the key-depression velocity yielding the same velocity value Vca of the touch curves TW1 through TW15 gradually increases in the order of reference number. For example, the touch curve TW1 which makes the key perceived as light requires a small key-depression velocity value Kva' in order to obtain the velocity value Vca, while the touch curve TW14 which makes the key perceived as heavy requires a quite great key-depression velocity value Kva in order to obtain the same velocity value Vca. The touch curve selecting table SW associates the respective keys of the respective grades GW1 through GW4 with the touch curves TW1 through Tw15 in accordance with the difference between the weight characteristics GW and the desired weight characteristics DW. As shown in FIG. 5C, more specifically, the touch curves are assigned to the respective keys of each grade such that if depressions of the keys of a grade have the same velocity, the keys at the low note side yield a smaller velocity.

For example, if the player depresses a key K16 having the lowest tone pitch in the second grade GW2, the touch curve selecting portion M2 selects the touch curve TW14 which makes the key perceived as heavy in accordance with the correspondence defined by the touch curve selecting table SW. As shown in FIG. 5A, the velocity converting portion M3 then outputs the velocity value Vca provided for the touch curve TW14, the velocity value Vca corresponding to the key-depression velocity Kva. If a key K39 having the highest tone pitch in the second grade GW2 is depressed, the touch curve TW1 which makes the key perceived as light is selected, so that the key K39 only requires a key-depression velocity Kva'which is considerably smaller than the key-depression velocity required by the key K16 in order to obtain the same velocity Vca.

In a grade (e.g., GW2), more specifically, the touch curves (TW14 through TW1) associated with the respective keys (K16 through K39) have velocity characteristics (Kv-Vc characteristics) which make the player perceive the keys at the low note side of the grade as heavier and the keys at the high note side of the grade as lighter. As a result, the keyboard apparatus is controlled such that when the player depresses the respective keys of the grade to yield a certain loudness level, the player perceives the keys at the high note side as lighter and the keys at the low note side as heavier. As for switching time difference of the contact where a key-depression is detected for yielding the certain loudness level, in other words, the keyboard apparatus is controlled to have a longer time difference at the high note side and a shorter time difference at the low note side to obtain seamless and smooth touch response in the scaling direction, so that the desired gradually varying touch response DW is effectively approximated.

Even when the touch response is controlled to have steps between the grades, therefore, the keyboard apparatus according to the embodiment of the invention eliminates the need for mechanical control of the touch response over all the keys, and achieves smoothed perceptive touch response by dividing all the keys K1 through Kn (n=88 in the shown example) of the keyboard 14*k* into grades by software without difficulty.

In the case of (b), each grade is composed of fifteen keys. In each grade, the respective keys are assigned to the respective touch curves TW1 through TW15 in a one-to-one relationship. The correspondences between the keys and the touch curves are shared among all the grades. For the sake of simplicity, however, the one-to-one correspondences may be replaced with a scheme in which a plurality of keys, such as neighboring keys, the characteristics of the ideal touch curve of which are similar are assigned to the same touch curve. Because the respective grades do not necessarily have the same number of keys, furthermore, the respective grades may not have the same correspondences between the keys and the touch curves. In addition, a multiplicity of touch curves having various characteristics may be provided so that a touch curve having characteristics close to ideal can be assigned to each key. In order to achieve the most precise control, furthermore, touch curves, the number of which equals to the total number of the keys may be provided so that the touch selecting table SW can associate the keys with the touch curves in a one-to-one relationship.

[3] Case of (c)

In the case of (c), for example, the touch curve storage area TD stores the touch curves TW1 through TW15 as shown in FIG. 5A in accordance with the weighting rule rv2, and also stores a difference table indicative of the difference between the actual weight characteristics GWa of each key Ki and the designed weight characteristics GW of the key in accordance with the equalization rule rv1. In the difference table, more specifically, each key Ki is provided with its amount shifted in the transverse axis (key-depression velocity Kv) of a touch curve corresponding to the key Ki [equivalent to the relative position with respect to the standard position in the transverse axis direction of the respective touch curves TW1 through TW4 in FIG. 4A]. In addition, the touch curve selecting portion SW has a capability of selecting a touch curve corresponding to the actually depressed key Ki from the touch curve storage area TD as in the case of (b), as well as reading out the amount shifted in the transverse axis direction corresponding to the depressed key Ki from the difference table, converting the selected touch curve into a touch curve which has been shifted in the transverse axis direction by the shifted amount, and delivering the converted touch curve to the velocity converting portion M3.

In other words, the touch curve selecting portion SW selects a touch curve which causes keys in the lower notes to yield a smaller velocity in accordance with the difference between the weight characteristics GW and the desired characteristics DW if all the keys in a grade are depressed with the same key-depression velocity. The touch curve selecting portion SW then shifts the selected touch curve in the transverse axis direction, so that the touch curve selecting portion SW outputs a touch curve TWr having characteristics which also cancel a deviation in accordance with the difference between the actual weight characteristics GWa and the designed weight characteristics GW of each key. The velocity converting portion M3 then outputs the velocity value Vca corresponding to the actual key-depression velocity Kva in accordance with the touch curve TWr, so that the mechanical deviation is perceptively equalized, resulting in the smoothed touch response over all the grades, the touch response gradually varying in the scaling direction. In addition, the velocity converting portion M3 may have the capability of shifting a touch curve in the transverse axis direction so that the velocity converting portion M3 can read out the amount shifted in the transverse axis direction of the depressed key Ki from the difference table and shift the actual key-depression velocity Kva by the read shifted amount.

[Example of Process Flow]

Figure 6:
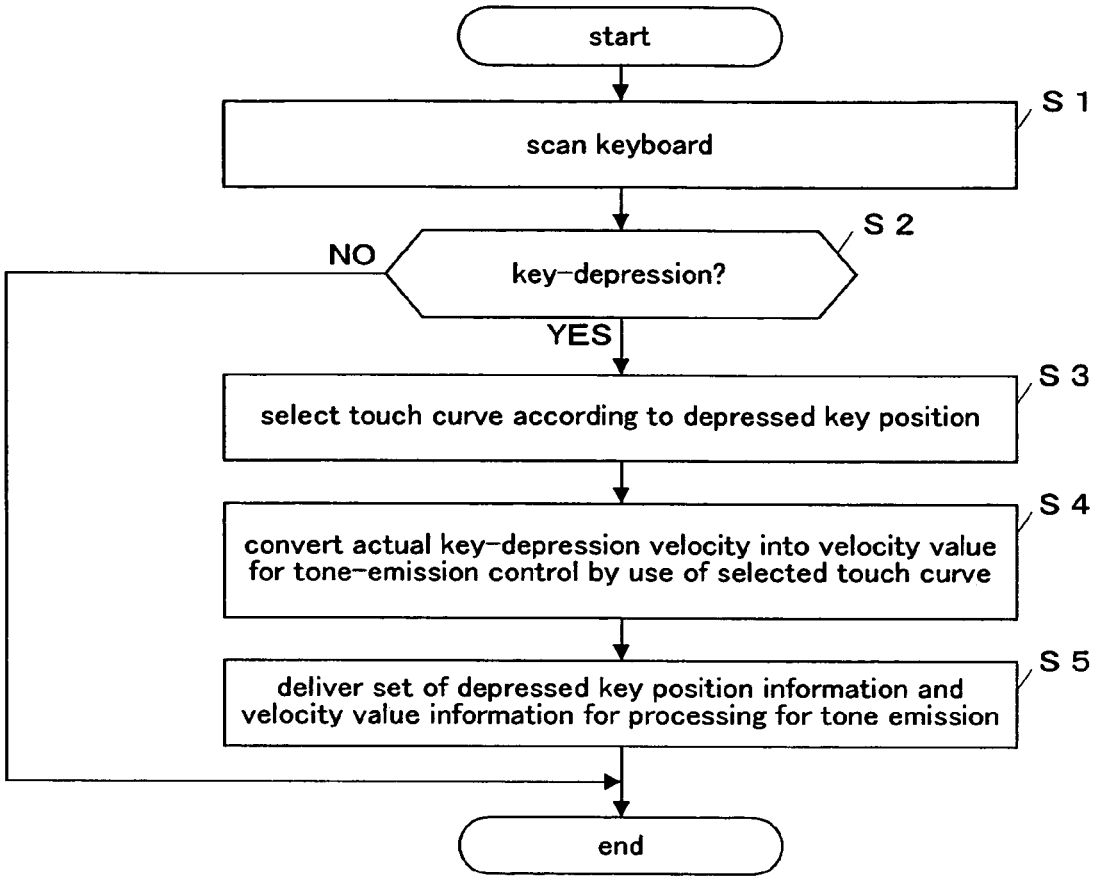
FIG. 6 is a flowchart showing a procedure of a touch-control process according to the embodiment of the invention.

FIG. 6 shows a flowchart of example procedural steps of a touch-control process according to the embodiment of the invention. The touch-control process is started by a timer at every timing of the scanning of the keyboard. If the process flow is started, the CPU 1 scans the operational state of the keyboard 14*k* at step S1, and determines at a key-depression determining step S2 whether any key has been depressed. If any key-depression has not been made (S2→NO), but any other key-operation (e.g., key-release) has been made, an appropriate process is performed before completing the touch-control process of this timing. If no key-operation has been made, the touch-control process is immediately terminated at this timing.

If the player has depressed a key of the keyboard 14*k* to play music (S2→YES), the process proceeds to a touch curve selecting step S3. At step S3, by use of the curve selecting table SW, SB, a touch curve (velocity curve) TWr, TBs is selected on the basis of the depressed key position Ki detected by the key-depression information generating portion M1. Then, at a velocity converting step S4, in accordance with the selected touch curve TWr, TBs, the actual key-depression velocity Kva detected at the player's key-depression of this timing by the key-depression information generating portion M1 is converted into a velocity value Vca provided for control of emission of a tone.

At a musical tone data outputting step S5, information on the depressed key position Ki and information on the velocity value Vca is delivered as a set of musical tone data for controlling emission of a tone to the musical tone signal generating portion 8, 9. After the processing for emitting a tone by the musical tone signal generating portion 8, 9, the touch-control process of this timing is terminated.

<Concrete Examples of Equalization and Smoothing>

As described in the case of (c), on the keyboard of the graded hammer type designed such that the keys in the lower registers yield heavier stepwise touch response (referred to as "hard grade") due to the reaction force mechanism, the equalization rule rv1 absorbs deviations of the touch response in the respective grades to achieve perceptive equalization of the touch response in the respective grades, while the weighting rule rv2 eases steps between the grades (grade steps) to smooth the changes in the touch response to make the player perceive the touch response as gradually varying in the scaling direction over all the grades. FIG. 7, FIGS. 8A through 8C, and FIGS. 9A, 9B show examples of equalization and smoothing of the touch response of the keyboard realizing the grading of all the keys (e.g., 88 keys) by combined use of the equalization and smoothing rules rv1, rv2. In the respective examples, the white keys and the black keys have their own grades (key ranges), and the touch-control process is separately performed for the white keys and the black keys.

Figure 7:
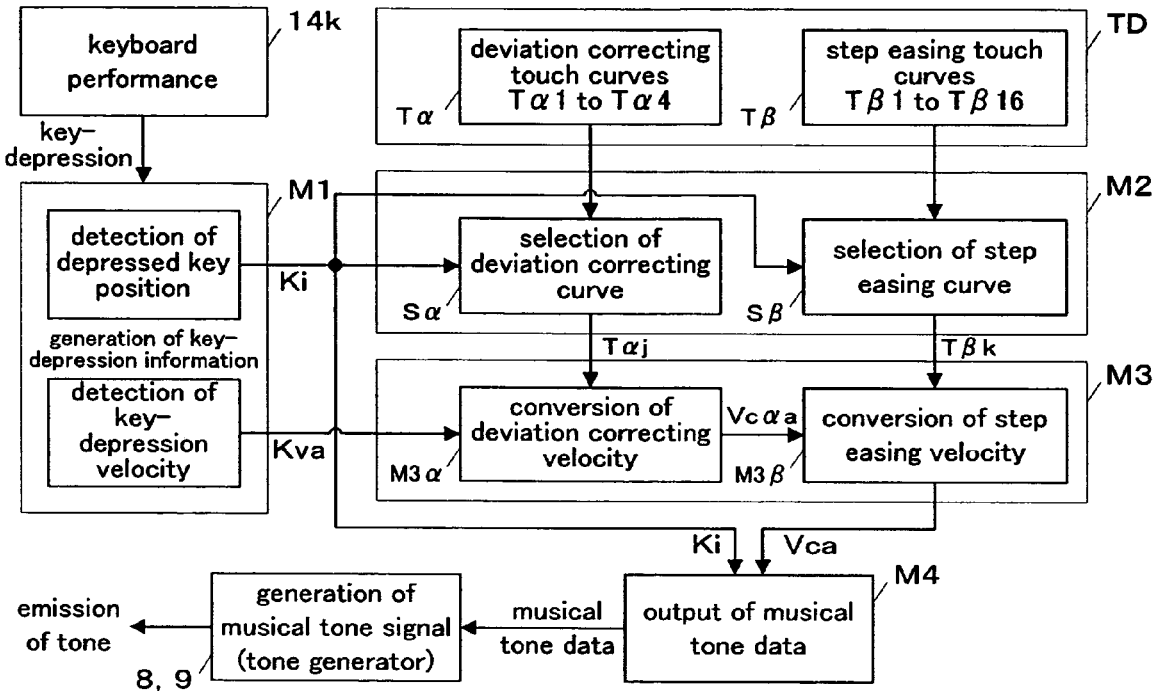
FIG. 7 is a functional block diagram showing a first example of equalization and smoothing of touch response of the keyboard according to the embodiment of the invention.
Figure 8A:
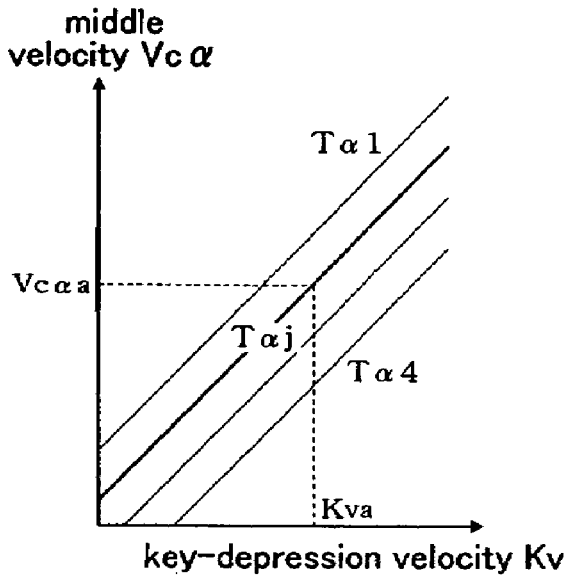
FIG. 8A is a diagram showing characteristics of touch curves (velocity curves) with respect to key-depression velocity for equalizing touch response of the keyboard according to the first example of equalization and smoothing of touch response of the keyboard.
Figure 8B:
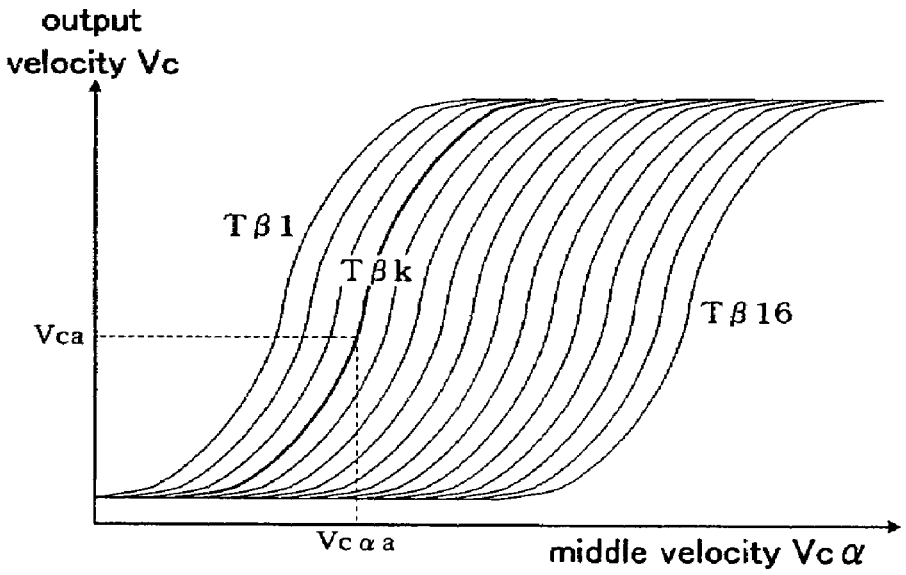
FIG. 8B is a diagram showing characteristics of touch curves (velocity curves) with respect to key-depression velocity for smoothing touch response of the keyboard according to the first example of equalization and smoothing of touch response of the keyboard.

In a first example of the equalization and smoothing of the touch response of the keyboard (FIG. 7 and FIGS. 8A through 8C), as shown in a functional block diagram of FIG. 7, the touch curve storage area TD of the storage portions 3, 4 stores, as in the cases of the touch curves TW of FIG. 4A and FIG. 5A, a deviation correcting touch curve group Tα for correcting deviations of the keys contained in each grade of the keyboard 14*k* and a step easing touch curve group Tβ for easing hard-grade steps. As shown in FIG. 8A, the touch curve group Tα is composed of a plurality (four in the shown example) of deviation correcting touch curves Tα1 through Tα4 defining correspondences between key-depression velocity Kv and middle velocity Vcα. As shown in FIG. 8B, the touch curve group Tβ is composed of a plurality (sixteen in the shown example) of step easing touch curves Tβ1 through Tβ16 defining correspondences between middle velocity Vcα and output velocity Vc.

The touch curve selecting portion M2 includes a deviation correcting curve selecting table Sα and a step easing curve selecting table Sβ which associate a key Ki of the keyboard 14*k* with any of the deviation correcting touch curves Tα1 through Tα4 and any of the step easing touch curves Tβ1 through Tβ16, respectively. The key-depression information generating portion M1 generates information on key-depression including a depressed key position Ki and key-depression velocity Kva corresponding to a depressed key of the keyboard 14*k*. As a result, every time the player depresses a key to play music, the deviation correcting and step easing curve selecting tables Sα, Sβ are referred to select, from among the touch curve groups Tα, Tβ, deviation correcting and step easing touch curves Tαj (j=1 through 4), Tβk (k=1 through 16) corresponding to the depressed key position Ki.

The velocity converting portion M3 is composed of deviation correcting and step easing velocity converting portions M3α, M3β. The deviation correcting velocity converting portion M3α converts the key-depression velocity Kva into a middle velocity value Vcαa in accordance with a deviation correcting touch curve Tαj selected at every key-depression from the deviation correcting curve selecting table Sα [FIG. 8A]. The step easing velocity converting portion M3β converts the middle velocity value Vcαa into a value Vca which is the final output velocity Vc in accordance with a step easing touch curve Tβk selected at every key-depression from the step easing curve selecting table Sβ [FIG. 8B]. At each key-depression, consequently, the conversion of the key-depression velocity Kva in accordance with a deviation correcting touch curve Tαj and the further conversion of a step between grades in accordance with a step easing touch curve Tβk result in a final velocity Vca which satisfies the characteristics of both the touch curve Tαj for correcting deviation of the key and the touch curve Tβk for easing the step between the hard grades. The musical tone data generating portion M4 then generates musical tone data composed of a set of the depressed key position information Ki and the output velocity information Vca delivered from the key-depression information generating portion M1 to allow the musical tone signal generating portion (tone generator) 8, 9 which conducts processing for emitting tones to generate a musical tone signal corresponding to the musical tone data.

Figure 8C:
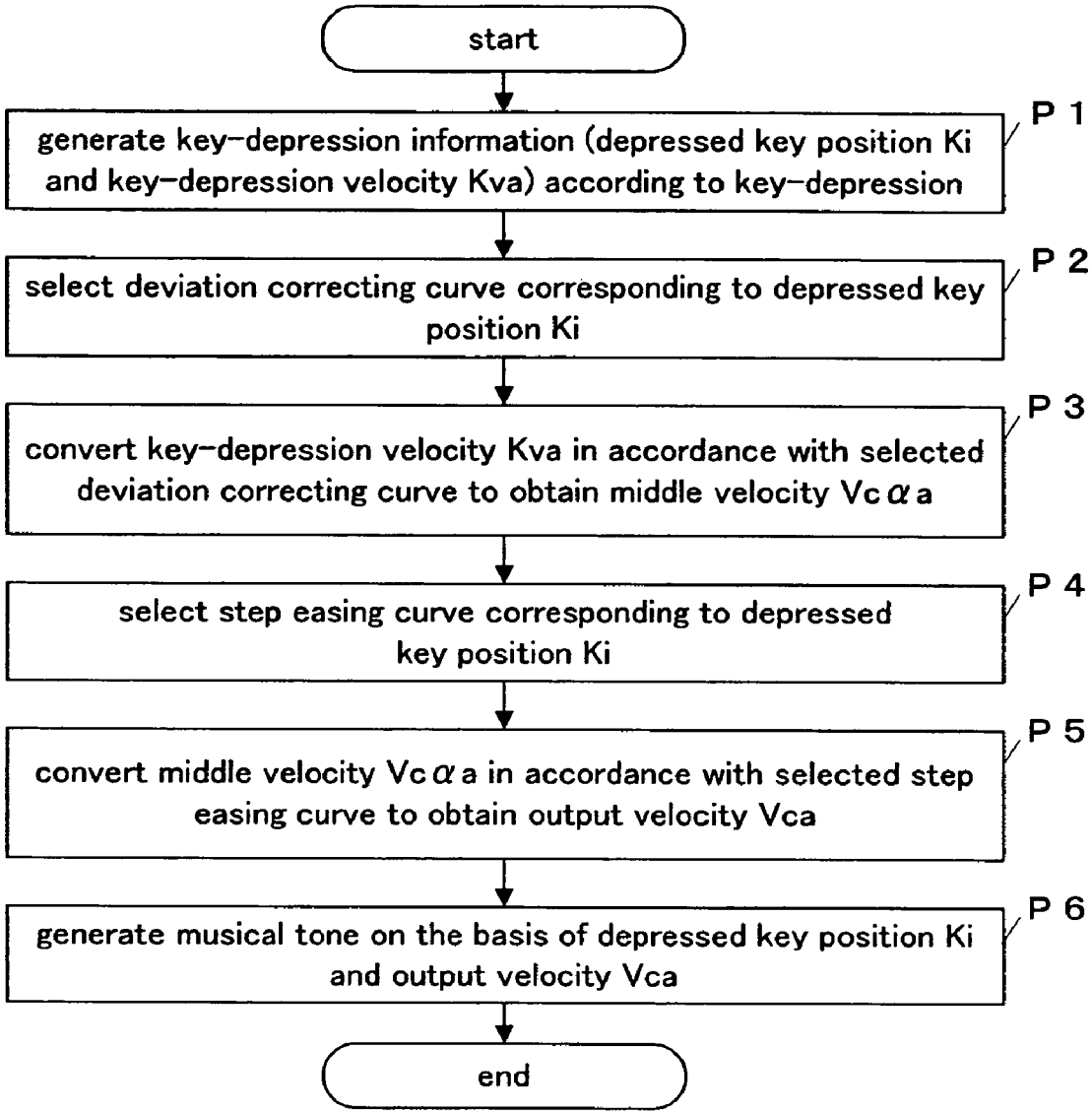
FIG. 8C is a flowchart showing a procedure for equalization and smoothing according to the first example of equalization and smoothing of touch response of the keyboard.

With reference to a process flow shown in FIG. 8C, operations of the process of the first equalization and smoothing example will be explained. If a key of the keyboard 14 is depressed by the player to play music, key-depression information including a depressed key position Ki and a key-depression velocity Kva corresponding to the player's key-depression is generated at the first step P1. In response to the generation of the key-depression information, at the next step P2, a deviation correcting touch curve Tαj corresponding to the depressed key position Ki is selected from the deviation correcting touch curve group Tα: Tα1 through Tα4. At step P3, in accordance with the selected deviation correcting touch curve Tαj, a middle velocity Vcαa is obtained on the basis of the key-depression velocity Kva. At step P4, a step easing touch curve Tβk corresponding to the depressed key position Ki is selected from the step easing touch curve group Tβ: Tβ1 through Tβ16. At step P5, in accordance with the selected step easing touch curve Tβk, an output velocity value Vca is obtained on the basis of the middle velocity Vcαa. At step P6, a musical tone is generated on the basis of the depressed key position Ki and the output velocity Vca.

In a second example of the equalization and smoothing of the touch response of the keyboard (FIGS. 9A, 9B), a multiplicity of deviation-correcting and step-easing touch curves obtained by combination of the two different touch curve groups of the deviation correcting touch curve group and the step easing touch curve group are previously provided. Each key of the keyboard is assigned to one of the deviation-correcting and step-easing touch curves to obtain a velocity corresponding to a key-depression velocity in accordance with the deviation-correcting and step-easing touch curve determined on the basis of the position of the depressed key. A concrete example will be provided with reference to FIGS. 9A, 9B. In this example as well as the first equalization and smoothing example, take the number M of the deviation correcting touch curves as four and the number N of the step easing touch curves as sixteen, resulting in sixty four different deviation-correcting and step-easing touch curves corresponding the product of M and N. As shown in the functional block diagram of FIG. 9A, a deviation-correcting and step-easing touch curve group Tγ composed of the curves Tγ1 through Tγ4 is stored in the touch curve storage area TD. The number of the deviation-correcting and step-easing touch curves is not necessarily the product of the number of the deviation-correcting curves (M) and the number of the step-easing curves (N) as applied to this example, but can be reduced by shared use of a curve by a plurality of keys requiring similar characteristics.

The touch curve selecting portion M2 includes a deviation-correcting and step-easing touch curve selecting table Sγ which associates each key Ki of the keyboard 14*k* with any of the deviation-correcting and step-easing touch curves Tγ1 through Tγ64. If the key-depression information generating portion M1 generates, at every key-depression on the keyboard 14*k* by the player to play music, key-depression information including a depressed key position Ki and a key-depression velocity Kva corresponding to the key-depression on the keyboard 14*k*, the touch curve selecting portion M2 selects a touch curve Tγm (m=1 through 64) corresponding to the depressed key position Ki from the deviation-correcting and step-easing touch curve group Tγ in accordance with the table Sγ. The velocity converting portion M3, which is composed of deviation-correcting and step-easing velocity converting portion M3γ, converts a key-depression velocity Kva into a velocity Vca in accordance with the key-depression velocity Kv-velocity Vc characteristics of the touch curve Tγm selected from the table Sγ at every key-depression. The musical tone data generating portion M4 then generates musical tone data composed of a set of the depressed key position information Ki delivered from the key-depression information generating portion M1 and the velocity information Vca to allow the musical tone signal generating portion (tone generator) 8, 9 which conducts processing for emitting tones to generate a musical tone signal corresponding to the musical tone data.

Figure 9A:
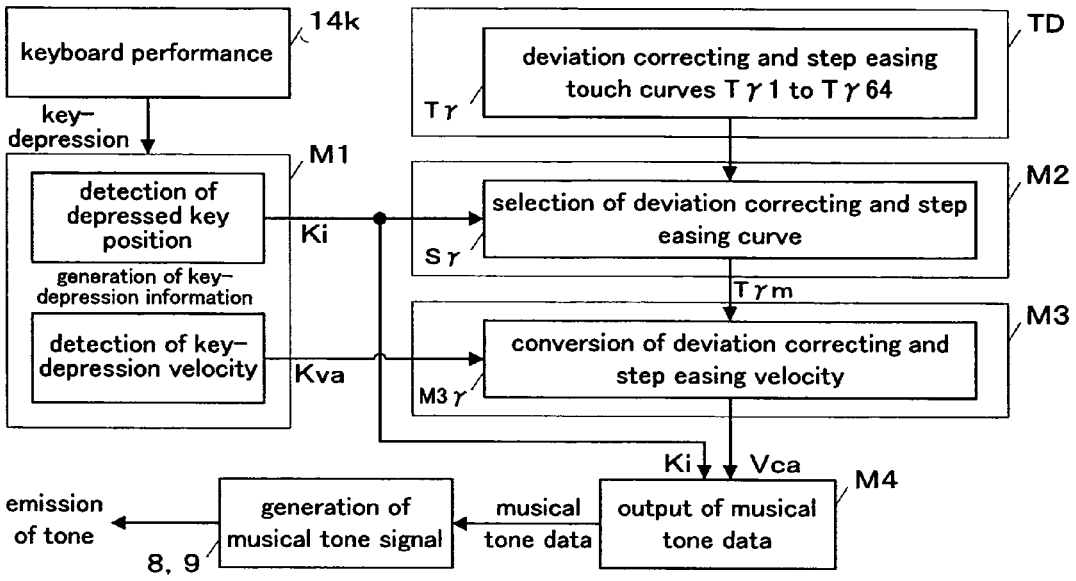
FIG. 9A is a functional block diagram showing a second example of equalization and smoothing of touch response of the keyboard according to the embodiment of the invention.
Figure 9B:
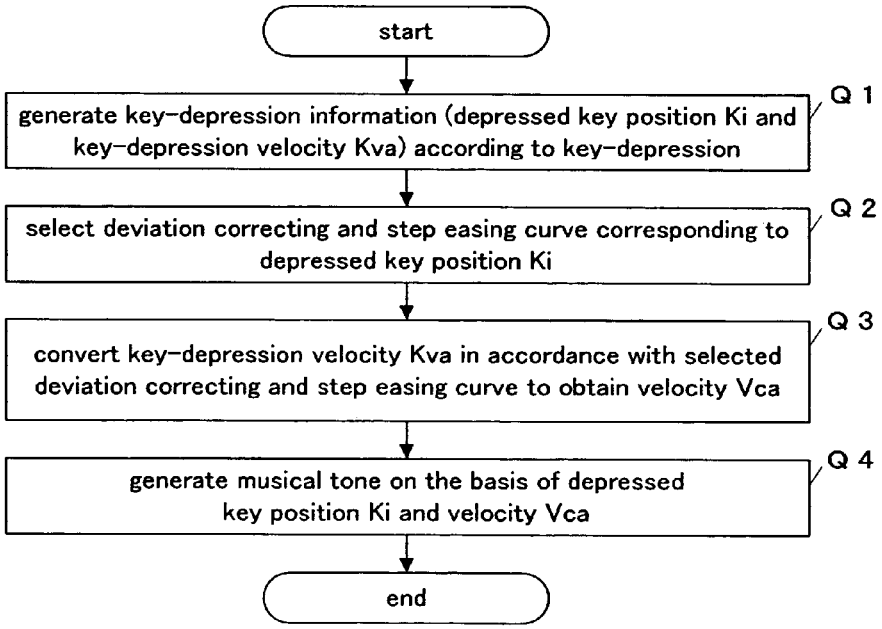
FIG. 9B is a flowchart showing a procedure for equalization and smoothing according to the second example of equalization and smoothing of touch response of the keyboard.

With reference to a process flow shown in FIG. 9B, operations of the process of the second equalization and smoothing example will be explained. If a key of the keyboard 14*k* is depressed by the player to play music, key-depression information including a depressed key position Ki and a key-depression velocity Kva corresponding to the player's key-depression is generated at the first step Q1. At the next step Q2, in response to the generation of the key-depression information, a deviation-correcting and step-easing touch curve Tγm corresponding to the depressed key position Ki is selected from the deviation-correcting and step-easing touch curves Tγ:Tγ1 through Tγ64. At step Q3, in accordance with the selected touch curve Tγm, a velocity Vca is obtained on the basis of the key-depression velocity Kva. At step Q4, a musical tone is generated on the basis of the depressed key position Ki and the velocity Vca.

[Generation of Velocity by Calculation]

In the embodiment described above, touch curves are previously stored to obtain a velocity through the reference to the tables containing the touch curves. However, the velocity may be obtained by another scheme. In the another scheme, parameters on mechanical weight characteristics of the respective keys are previously stored to perform, on the basis of a successively input depressed key position and key-depression velocity, and the parameter, calculations in accordance with the velocity response rule rv0, the equalization rule rv1 and the weighting rule rv2 to obtain a velocity similar to that obtained through the reference to the tables.

In the case of (a), for example, a weighting characteristic selecting table SW' which associates key-depression information with perceptive weighting characteristics (also referred to as "weighting parameter") of the touch curves is previously stored in the storage portions 3, 4 to obtain perceptive weighting characteristics Pw on the basis of key-depression information Ki. On the basis of the obtained value of the perceptive weighting characteristics Pw and the key-depression velocity value Kva, a calculation of the following equation (1) is performed to obtain the velocity Vca:

$$Vca=\{1-(1-Kva)^{1/Pw}\}^{Pw} \quad \text{Eq. 1}$$

Where the key-depression velocity Kva and the velocity Vca are normalized to take a value from 0 to 1.

In the equation 1, the weighting characteristics Pw, which is a real number higher than 0, represents the characteristics making the key perceived as heavier as the value of the weighting characteristics Pw increases. The weighting characteristic selecting table SW' assigns the keys whose reaction force deviates more (keys whose touch response is heavy) the characteristics Pw of a smaller value so that the keys are perceived as lighter, while assigning the keys whose reaction force deviates less (keys whose touch response is light) the characteristics Pw of a larger value so that the keys are perceived as heavier.

Figure 10:
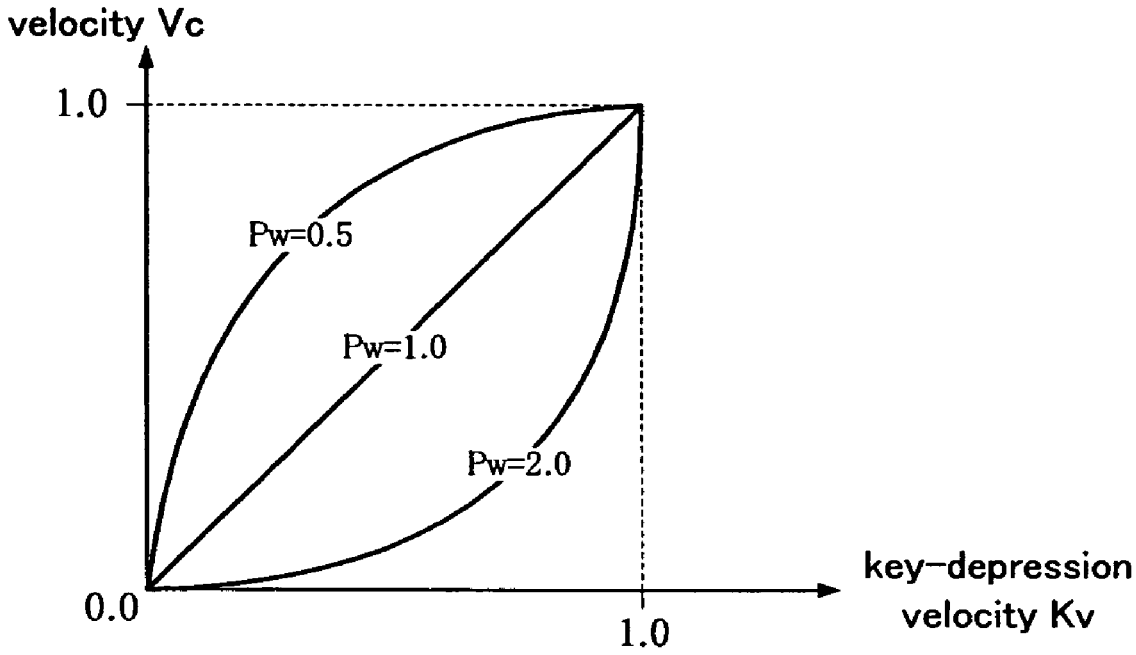
FIG. 10 is a diagram showing characteristics of velocity with respect to key-depression velocity according to another embodiment of the invention.

As shown in Kv (key-depression velocity)-Vc (velocity) characteristics of FIG. 10, the equation 1 indicates that as the key-depression velocity value Kva increases, so does the value of Vca. According to the equation 1, in addition, as the value of the perceptive weighting characteristics Pw grows, the key is perceived as heavier. By use of the weighting characteristic selecting table SW' and the equation (1), therefore, the value of Vca which follows the velocity response rule rv0 and the equalization rule rv1 can be obtained.

In the case of (b) as well as (a), the weighting characteristic selecting table SW' which associates key-depression information with perceptive weighting characteristics of the touch curves is previously stored in the storage portions 3, 4 to obtain perceptive weighting characteristics Pw on the basis of key-depression information Ki. On the basis of the obtained value of the perceptive weighting characteristics Pw and the key-depression velocity value Kva, the calculation is performed to obtain a velocity Vca. In the case of (b), the weighting characteristic selecting table SW' assigns the keys in the lower notes to the characteristics Pw of a larger value so that the keys are perceived as heavier, while assigning the keys in the higher notes to characteristics Pw of a smaller value so that the keys are perceived as lighter. By use of the weighting characteristic selecting table SW' and the equation (1), as a result, the value of Vca which follows the velocity response rule rv0 and the weighting rule rv2 can be obtained.

Figure 11A:
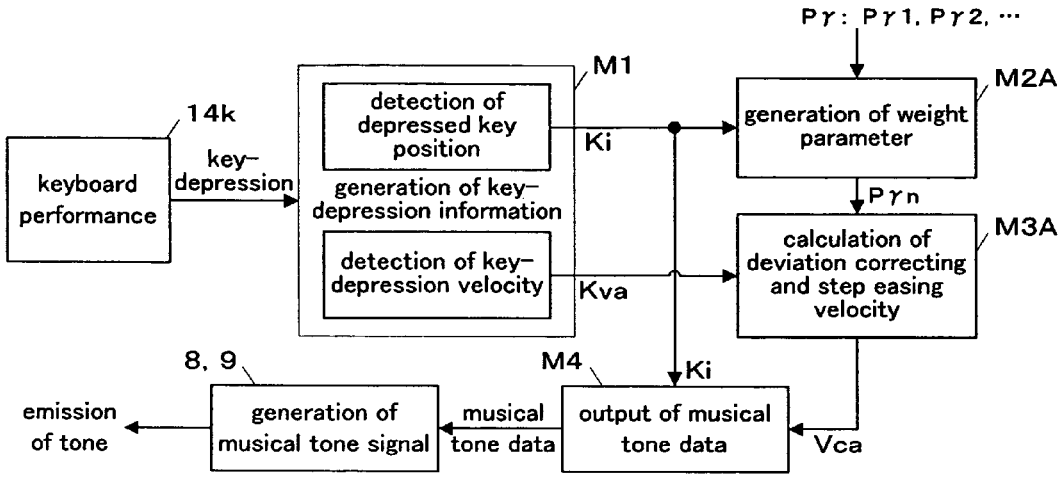
FIG. 11A is a functional block diagram showing a third example of equalization and smoothing of touch response of the keyboard according to the another embodiment.
Figure 11B:
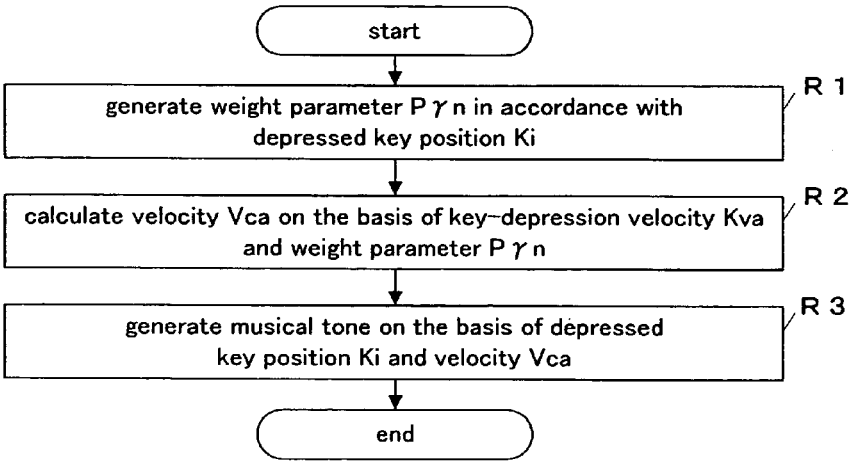
FIG. 11B is a flowchart showing a procedure for equalization and smoothing according to the third example of equalization and smoothing of touch response of the keyboard.

In the case of (c) as well as (a) and (b), velocity can be obtained by calculation. FIGS. 11A, 11B show a third example of the equalization and smoothing of the touch response of the keyboard (the third equalization/smoothing example) in which a velocity is generated by calculation. In the third equalization/smoothing example, a weight parameter Pγ equivalent to a perceptive load (weight) obtained from a value for correcting deviation of a key and a value for easing a step between grades is applied to the weighting characteristics (weight parameter) Pw of the equation (1), the weighting characteristics Pw being representative of a Kv-Vc curve as shown in FIG. 10, so that a desired velocity Vca is obtained. In this case as well, the white keys and the black keys have their own grades (key ranges), and the touch-control process is separately performed for the white keys and the black keys.

A concrete explanation will be given with reference to FIG. 11A. The storage portions 3, 4 previously stores a deviation-correcting and step-easing weight parameter group Pγ composed of a multiplicity of deviation-correcting and step-easing weight parameters (weighting characteristics) Pγ1, Pγ2, . . . obtained by combination of two different weight parameter (weighting characteristics) groups of deviation-correcting weight parameter group and step-easing weight parameter group. The storage portions 3, 4 also stores a deviation-correcting and step-easing weight parameter (weighting characteristics) selecting table Sγ' (not shown) which associates a key Ki of the keyboard 14*k* with one of the weight parameters Pγ1, Pγ2, . . . The deviation-correcting and step-easing weight parameter Pγ: Pγ1, Pγ2, . . . is represented by the product of a deviation-correcting weight parameter Pα:Pα1, Pα2, . . . for correcting deviation and a step-easing weight parameter Pβ:Pβ1, Pβ2, . . . for easing a step, the deviation-correcting weight parameter Pα being equivalent to the weighting characteristics Pw of the case (a), and the step-easing weight parameter Pβ being equivalent to the weighting characteristics Pw of the case (b).

A weight parameter generating portion M2A includes the deviation-correcting and step-easing weight parameter selecting table Sγ'. The key-depression information generating portion M1 generates key-depression information containing a depressed key position Ki and a key-depression velocity Kva corresponding to a key-depression on the keyboard 14*k*. At every key-depression by the player to play music, therefore, a deviation-correcting and step-easing weight parameter Pγn (n=1, 2, . . .) corresponding to the depressed key position Ki is generated from the deviation-correcting and step-easing weight parameter group Pγ: Pγ1, Pγ2, . . . in accordance with the parameter selecting table Sγ'. A deviation-correcting and step-easing velocity computing portion M3A applies a deviation-correcting and step-easing weight parameter Pγn generated at every key-depression by the weight parameter generating portion M2A to the weight parameter Pw of the equation (1) to obtain a velocity Vca from the equation (1) by use of the key-depression velocity Kva delivered from the key-depression information generating portion M1. The musical tone data generating portion M4 then generates musical tone data composed of a set of the depressed key position information Ki delivered from the key-depression information generating portion M1 and the output velocity information Vca to allow the musical tone signal generating portion (tone generator) 8, 9 which conducts processing for emitting tones to generate a musical tone signal corresponding to the musical tone data.

With reference to a process flow shown in FIG. 11B, operations of the process of the third equalization/smoothing example will be explained. Upon generation of key-depression information containing a depressed key position Ki and a key-depression velocity Kva in response to a key-depression on the keyboard 14*k*, a deviation-correcting and step-easing weight parameter Pγn corresponding to the depressed key position Ki is generated from the deviation-correcting and step-easing weight parameter group Pγ: Pγ1, Pγ2 . . . at step R1. At the next step R2, the key-depression velocity Kva and the weight parameter Pγn (→Pw) are applied to the equation (1) to obtain a velocity Vca. At step R3, a musical tone is generated on the basis of the depressed key position Ki and the velocity Vca.

In the third example, the storage portions 3, 4 stores the deviation-correcting and step-easing weight parameter group Pγ so that the deviation-correcting and step-easing velocity computing portion M3A selects, on the basis of the deviation-correcting and step-easing weight parameter selecting table Sγ' which associates a depressed key position Ki with a weight parameter, a weighting parameter Pγn corresponding to the depressed key position Ki. However, the storage portions 3, 4 may store the deviation-correcting weight parameters Pα:Pα1, Pα2, . . . and the step-easing weight parameters Pβ:Pβ1, Pβ2, . . . , the deviation-correcting parameter selecting table Sα' which assigns a deviation-correcting weight parameter Pα to a depressed key position Ki, and the step-easing parameter selecting table Sβ' which assigns a step-easing weight parameter Pβ to the depressed key position Ki so that the deviation-correcting and step-easing velocity computing portion M3A selects, on the basis of the tables Sα', Sβ', weight parameters Pα, Pβ associated with the depressed key position Ki and multiplies the selected parameter Pα by the parameter Pβ to obtain the weight parameter Pγn corresponding to the depressed key position Ki.

In order to obtain a velocity Vca on the basis of a key-depression velocity Kva, the third example uses the equation 1 (FIG. 10) where the weight parameter (Pw) takes a positive real number with respect to 1.0. Consequently, the deviation-correcting and step-easing weight parameter Pγ can be obtained by the product of Pα and Pβ, namely, the product of the weight parameter Pα for correcting deviation and the weight parameter Pβ for easing a step. In a case where an equation in which a weight parameter can take both positive and negative values with respect to 0 is used, however, the weight parameter Pγ can be obtained by the sum of the weight parameter Pα for correcting deviation and the weight parameter Pβ for easing a step.

[Various Embodiments]

The embodiments of this invention have been described with reference to the drawings, however, the above embodiments are mere examples. Therefore, various modifications may be made without departing from the spirit and scope of the invention. For instance, the touch response controlling capability by software of this invention can be also applied to keyboards having a reaction force mechanism with no structural elaboration such as a case where all the keys are designed to have the same weight characteristics (e.g., non-graded keyboard).

In the embodiments, furthermore, the processing are separately performed for the white keys and the black keys, however, for simplicity, the processing may be performed for both the white keys and the black keys by use of the same table (TW and TB, or SW and SB, or TWr and TBs).

What is claimed is:

1. A keyboard apparatus of an electronic musical instrument comprising:

a keyboard containing a plurality of keys having a reaction force mechanism for exerting a reaction force at each key-depression;

a key-depression detecting portion for detecting a depressed key position and a key-depression velocity on the basis of a key-depression on the keyboard; and a velocity generating portion for generating a velocity in accordance with a specified velocity generation rule on the basis of the depressed key position and the key-depression velocity detected by the key-depression detecting portion, the velocity generation rule including:

a velocity response rule for providing a small velocity for a key-depression having a small key-depression velocity, and providing a large velocity for a key-depression having a large key-depression velocity if positions of the depressed keys are identical; and a touch response correction rule for providing a large velocity for a key exerting an excessive reaction force at a key-depression, and providing a small velocity for a key exerting an insufficient reaction force at a key-depression if the keys are depressed with an identical velocity.

2. A keyboard apparatus of an electronic musical instrument according to claim 1, wherein the touch response correction rule is an equalization rule for providing a large velocity for a depression of a key exerting a largely deviating reaction force, and providing a small velocity for a depression of a key exerting a slightly deviating reaction force if the keys are depressed with an identical velocity.

3. A keyboard apparatus of an electronic musical instrument according to claim 1, wherein the touch response correction rule is a weighting rule for providing a small velocity for a depression of a key positioned at a low note side, and providing a large velocity for a depression of a key positioned at a high note side if the keys are depressed with an identical velocity.

4. A keyboard apparatus of an electronic musical instrument according to claim 1, wherein the touch response correction rule includes:

an equalization rule for providing a large velocity for a depression of a key exerting a largely deviating reaction force, and providing a small velocity for a depression of a key exerting a slightly deviating reaction force if the keys are depressed with an identical velocity; and a weighting rule for providing a small velocity for a depression of a key positioned at a low note side, and providing a large velocity for a depression of a key positioned at a high note side if the keys are depressed with an identical velocity.

5. A keyboard apparatus of an electronic musical instrument according to claim 1, wherein the touch response correction rule is a key-range weighting rule for providing a small velocity for a depression of a key positioned at a low note side in one of a plurality of key ranges into which the plurality of keys are divided, and providing a large velocity for a depression of a key positioned at a high note side in the key range if the keys are depressed with an identical velocity.

6. A keyboard apparatus of an electronic musical instrument according to claim 1, wherein the touch response correction rule includes:

an equalization rule for providing a large velocity for a depression of a key exerting a largely deviating reaction force, and providing a small velocity for a depression of a key exerting a slightly deviating reaction force if the keys are depressed with an identical velocity; and a key-range weighting rule for providing a small velocity for a depression of a key positioned at a low note side in one of a plurality of key ranges into which the plurality of keys are divided, and providing a large velocity for a depression of a key positioned at a high note side in the key range if the keys are depressed with an identical velocity.

7. A keyboard apparatus of an electronic musical instrument according to claim 1, wherein the velocity generation rule is separated into a white-key rule and a black-key rule; and the velocity generating portion applies the white-key rule to a case in which a depressed key position detected by the key-depression detecting portion is a white key, and applies the black-key rule to a case in which the depressed key position is a black key.

* * * * *